US005165203A

United States Patent [19]

Chuang

[11] Patent Number: 5,165,203

[45] Date of Patent: Nov. 24, 1992

[54] BELT-GRINDING MACHINE

[76] Inventor: Bor-Yann Chuang, No. 88-10, Tung-Ping Rd., Tai-Ping Hsiang, Taichung Hsien, Taiwan

[21] Appl. No.: 765,327

[22] Filed: Sep. 25, 1991

[51] Int. Cl.[5] ..... B24B 21/00

[52] U.S. Cl. ..... 51/135 R; 51/148

[58] Field of Search ..... 51/135 R, 138, 148

[56] References Cited

U.S. PATENT DOCUMENTS

| | | | |
|---|---|---|---|
| 2,791,070 | 5/1957 | Schaller | 51/148 |
| 3,451,174 | 6/1969 | Schaller | 51/148 |
| 3,577,684 | 5/1971 | Jakimcius | 51/148 |

FOREIGN PATENT DOCUMENTS

| | | | |
|---|---|---|---|
| 835707 | 4/1952 | Fed. Rep. of Germany | 51/148 |
| 1105307 | 4/1961 | Fed. Rep. of Germany | 51/148 |
| 843810 | 8/1960 | United Kingdom | 51/148 |

*Primary Examiner*—M. Rachuba

*Attorney, Agent, or Firm*—Finnegan, Henderson, Farabow, Garrett & Dunner

[57] ABSTRACT

A belt-grinding machine includes an upper roller having two aligned eccentric shafts extending from its two ends, a mounting shaft pivoted to one of said eccentric shafts, a lower roller, and an abrasive belt passing over the rollers. A belt loosening unit includes a hollow casing fixedly sleeved around the mounting shaft. A handle member is attached to the mounting shaft in order to turn the mounting shaft to rotate the upper roller between a first position, wherein the abrasive belt tensely passes over the rollers, and a second position, wherein the abrasive belt loosely passes over the rollers. A torsional spring is mounted in the casing to cause the mounting shaft to return from the first position to the second position. An adjustment unit includes a plate having an opening to engage a free end of the other eccentric shaft. The plate is movable to horizontally shift the other eccentric shaft to adjust the tension of the abrasive belt when the upper roller is in the first position.

1 Claim, 7 Drawing Sheets

BELT-GRINDING MACHINE

BACKGROUND OF THE INVENTION

1. Field of the Invention

This invention relates to a grinding machine, more particularly to an improved belt-grinding machine.

2. Description of the Related Art

Belt-grinding machines are used for stock removal and surface preparation. A conventional belt-grinding machine includes two spaced and parallel rollers, and an abrasive belt passing over the two rollers to complete some grinding operations. Time is wasted when detaching an old abrasive belt from the rollers as it is difficult to load on a new abrasive belt once the old one is worn. It is also inconvenient to adjust the tension of the abrasive belt when it becomes loose after a period of use.

SUMMARY OF THE INVENTION

Therefore, the objective of this invention is to provide an improved belt-grinding machine. The improved belt-grinding machine has an improved construction, so that it is easy to detach or load an abrasive belt and is convenient to adjust the tension of the abrasive belt when it becomes loose.

Accordingly, a belt-grinding machine of this invention includes a pair of upright support rods, and a mounting member mounted to the support rods in a vertically movable position. The mounting member includes an upper portion, a lower portion, and a mounting shaft rotatably supported by the upper portion of the mounting member. The mounting shaft has a first and a second end respectively extending out from the mounting member.

A horizontal upper roller includes an inner cylindrical member, and a coaxial outer cylindrical member rotatable with respect to the inner cylindrical member. The inner cylindrical member has two ends, and a first and a second eccentric shaft aligned to one another and respectively extending from the two ends. The first eccentric shaft is pivotally connected to the first end of the mounting shaft.

A horizontal lower roller has a first end mounted to the lower portion of the mounting member and a second end. The lower roller is right below the upper roller in a spaced parallel position.

An abrasive belt passes over the upper and lower rollers.

A belt loosening unit includes a hollow casing fixedly sleeved around the mounting shaft adjacent to the second end of the mounting shaft. A handle member is attached to the second end of the mounting shaft so as to turn the mounting shaft to rotate the upper roller between a first position, wherein the abrasive belt tensely passes over the upper and lower rollers, and a second position, wherein the distance between the axis of the upper roller and the axis of the lower roller is smaller than in the first position and the abrasive belt loosely passes over the upper and lower rollers. A torsional spring is mounted in the hollow casing and sleeved around the mounting shaft to cause the mounting shaft to return from the first position to the second position by the returning force of the torsional spring. A locking bolt is used to lock the mounting shaft in the first position against rotation. The locking bolt is connected to the hollow casing and releasably engaged with the mounting member.

A vertical stationary connecting plate has an upper end with a horizontally elongated hole formed thereon. The second eccentric shaft of the upper roller movably passes through the elongated hole of the upper end and has a free end projecting out of the connecting plate. The connecting plate further has a lower end connected to the second end of the lower roller.

An adjustment unit includes a plate member pivoted to the upper end of the connecting plate. The plate member has an opening formed thereon which engages the free end of the second eccentric shaft. The plate member is movable to horizontally shift the second eccentric shaft within the elongated hole in order to adjust the tension of the abrasive belt when the upper roller is in the first position. The adjustment unit further includes a locking member to lock the plate member to the connecting plate against movement.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
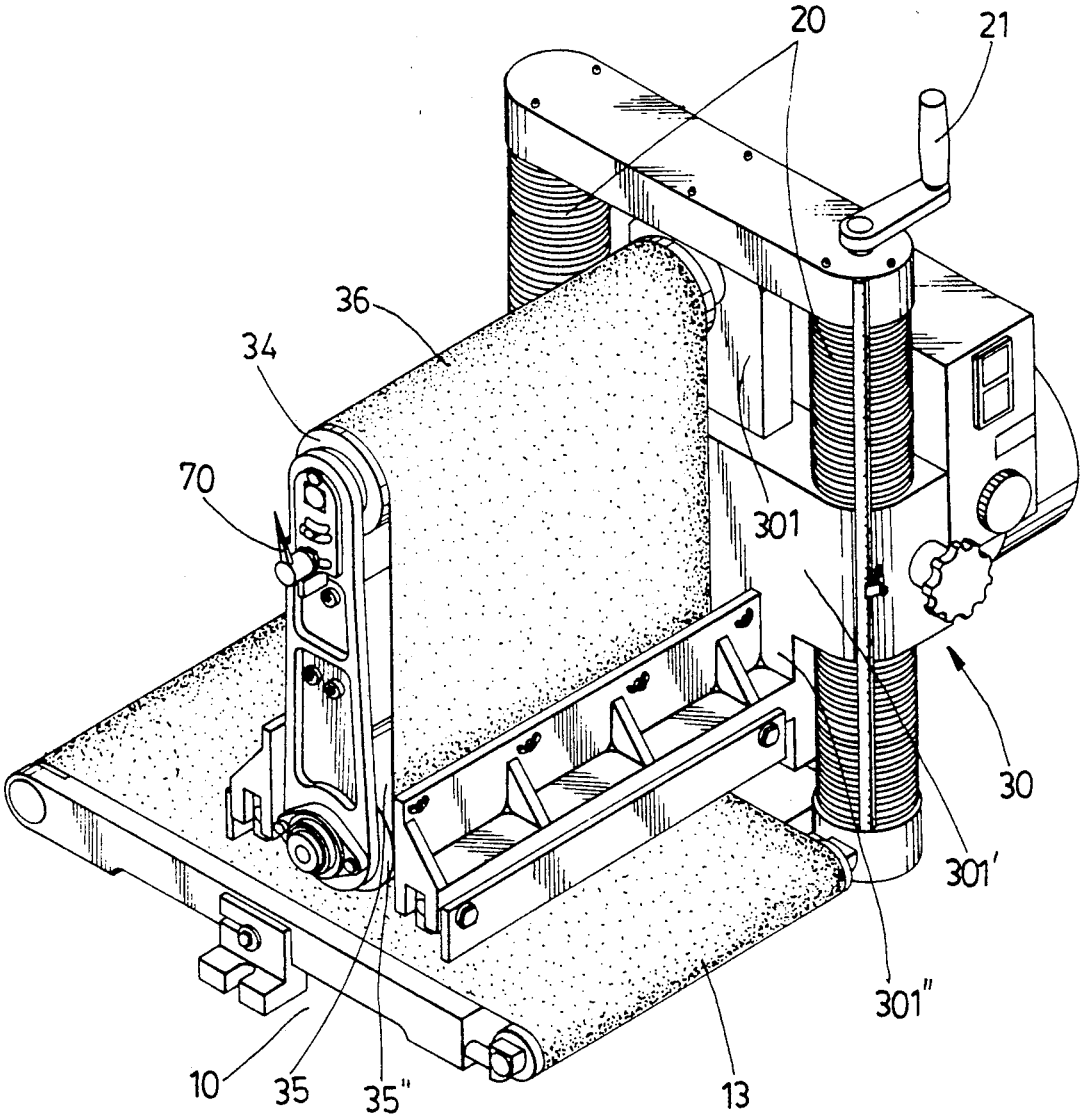
FIG. 1 is a perspective view of a preferred embodiment of the belt-grinding machine of this invention.
Figure 2:
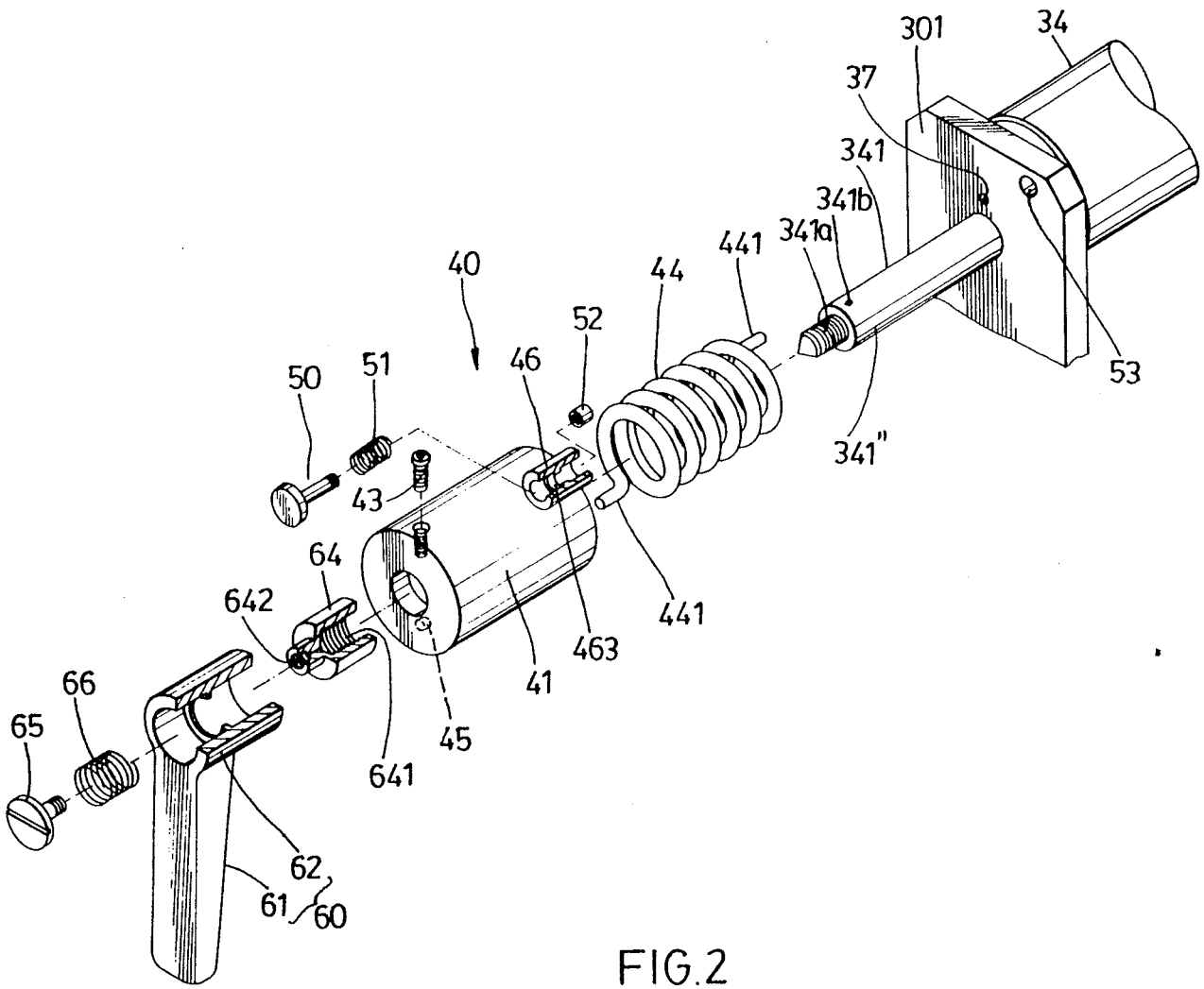
FIG. 2 is an exploded view of the belt loosening unit of the preferred embodiment.
Figure 3:
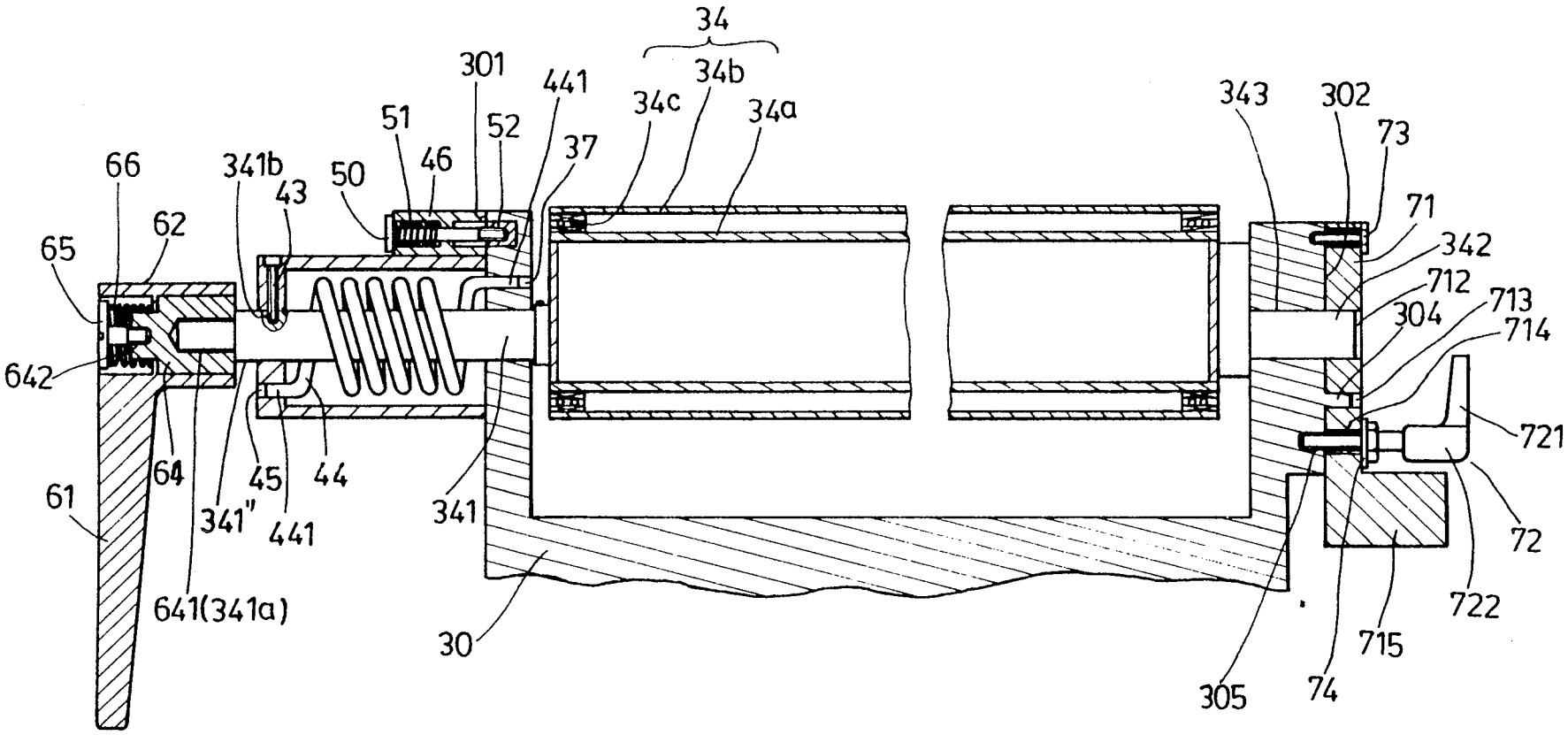
FIG. 3 is a partial sectional view of the preferred embodiment.

Referring to FIGS. 1 to 3, a belt-grinding machine of this invention includes a horizontal belt conveyor (10) to carry articles to be grounded thereon, and a pair of upright threaded support rods (20) provided with a handle member (21) located beside the belt conveyor (10). A mounting member (30) includes an upper portion (301), an intermediate portion (301'), and a lower portion (301''). The mounting member (30) is mounted to the support rods (20) in a vertically movable position above the belt conveyor (10) with the intermediate portion (301') sleeved around the support rods (20). A mounting shaft (341) is rotatably supported by the upper portion (301) of the mounting member (30). The mounting shaft (341) has a first and a second end (341', 341'') respectively extending out from the upper portion (301).

A horizontal upper roller (34) includes an inner cylindrical member (**34*a*), a coaxial outer cylindrical member (34*b*) rotatable with respect to the inner cylindrical member (34*a*), and a bearing unit (34*c*) provided between the inner and outer cylindrical members (34*a***, 34*b*). The inner cylindrical member (34*a*) has two ends, and a first and a second eccentric shaft (340, 342) aligned to one another and respectively extending from the two ends. The first eccentric shaft (340) is pivotally connected to the first end (341') of the mounting shaft (341) by a screw.

A horizontal lower roller (35) has a first end (not shown) mounted to the lower portion (301") of the mounting member (30) and a second end (35"). The lower roller (35) is right below the upper roller (34) in a spaced parallel position.

An abrasive belt (36) passes over the upper and lower rollers (34, 35).

A belt loosening unit (40) includes a hollow cylindrical casing (41) fixedly sleeved around the mounting shaft (341) adjacent to the second end (341") of the mounting shaft (341) by means of a screw (43) passing through said casing (41) and received in a hole (341*b*) of the mounting shaft (341). A handle member (60) includes a handling portion (61), an outer tubular portion (62), and an inner tubular portion (64) provided in the outer tubular portion (62) and having internal screw threads and a larger and a smaller part (641, 642). A bolt (65) threadedly engages the smaller part (642) of the inner tubular portion (64). A spring (66) is provided between the larger part (641) and a head of the bolt (65) and is sleeved around the smaller part (642) and a shank of the bolt (65). The second end (341") of the mounting shaft (341) has a threaded distal part (341*a*) engaging in the larger part (641) of the inner tubular portion (64). A torsional spring (44) is mounted in the hollow casing (41) and is sleeved around the mounting shaft (341). The torsional spring (44) has two ends (441) respectively received in a hole (45) of the hollow casing (41) and a hole (37) of the upper portion (301) of the mounting member (30). The hollow casing (41) has a tubular member (46) fixed to the outer surface thereof. The tubular member (46) has an intermediate annular flange (463) extending inwards from the inner surface of the tubular member (46). A locking bolt (50) is movably provided in the tubular member (46) and has an enlarged engaging head (52) caused to extend into a hole (53) of the upper portion (301) of the mounting member (30) by the force of an extension spring (51). The extension spring (51) is provided between the head of the locking bolt (50) and the intermediate annular flange (463) and is sleeved around the shank of the locking bolt (50).

Figure 4A:
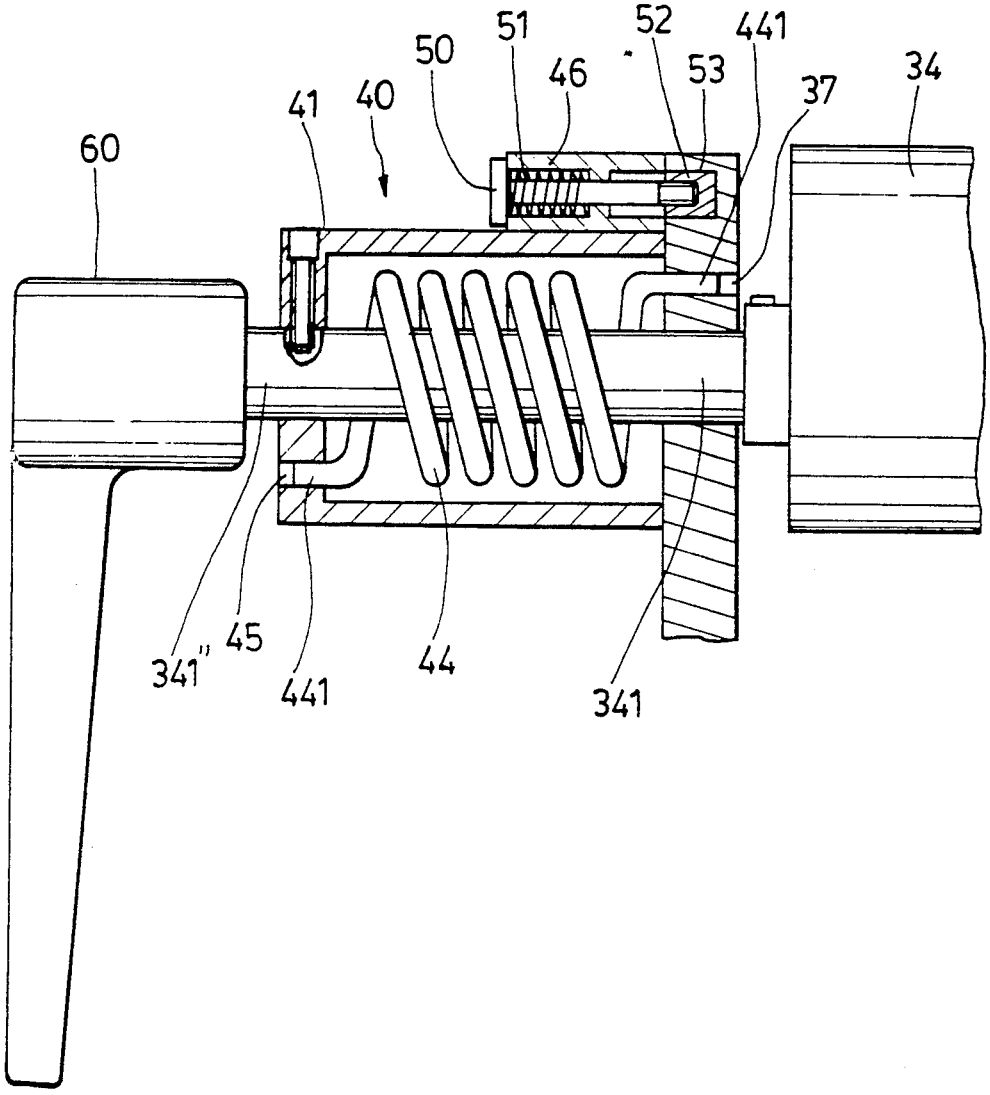
FIG. 4(A) is a schematic view showing that the belt loosening unit and the upper roller is in the first position.
Figure 4B:
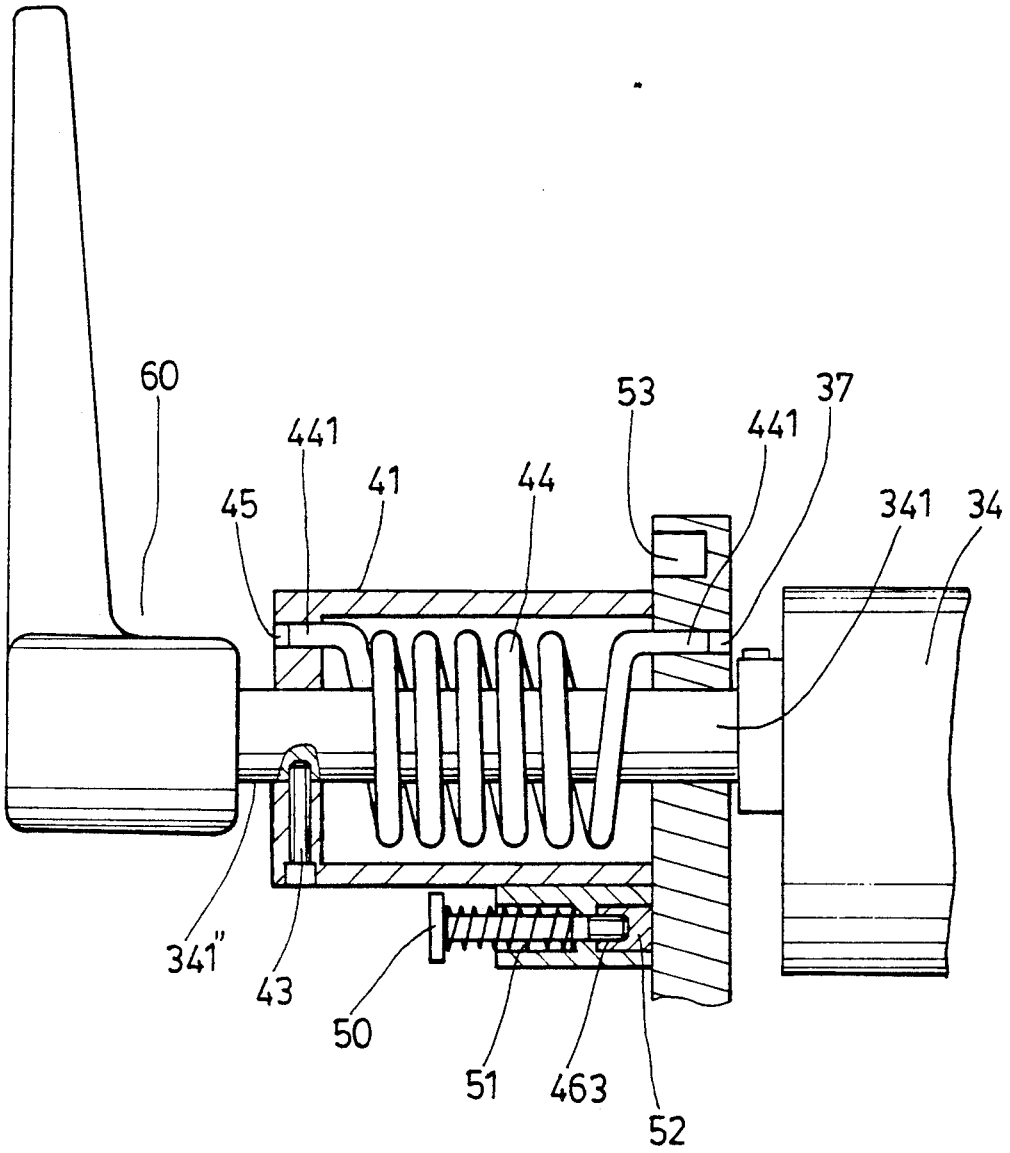
FIG. 4(B) is a schematic view showing that the belt loosening unit and the upper roller is in the second position.

Referring to FIGS. 4(A) and 4(B), the handle member (60) is attached to the second end (341") of the mounting shaft (341) in order to turn the mounting shaft (341) to rotate the upper roller (34) between a first position, wherein the abrasive belt (36) tensely passes over the upper and lower rollers (34, 35), and a second position, wherein the distance between the axis of the upper roller (34) and the axis of the lower roller (35) is smaller than in the first position and the abrasive belt (36) loosely passes over the upper and lower rollers (34, 35). The torsion spring (44) causes the mounting shaft (341) to return from the first position to the second position by its returning force. In grinding operation, the locking bolt (50) is inserted into the hole (53) of the upper portion (301) of the mounting member (30) to lock the mounting shaft (341) in the first position against rotation. The locking bolt (50) is pulled outwards to release from the upper portion (301) of the mounting member (30) when the mounting shaft (341) is rotated from the first position to the second position. Therefore, when the upper roller (34) is in the second position, the user can easily and conveniently detach the abrasive belt (36) for replacement.

Figure 5:
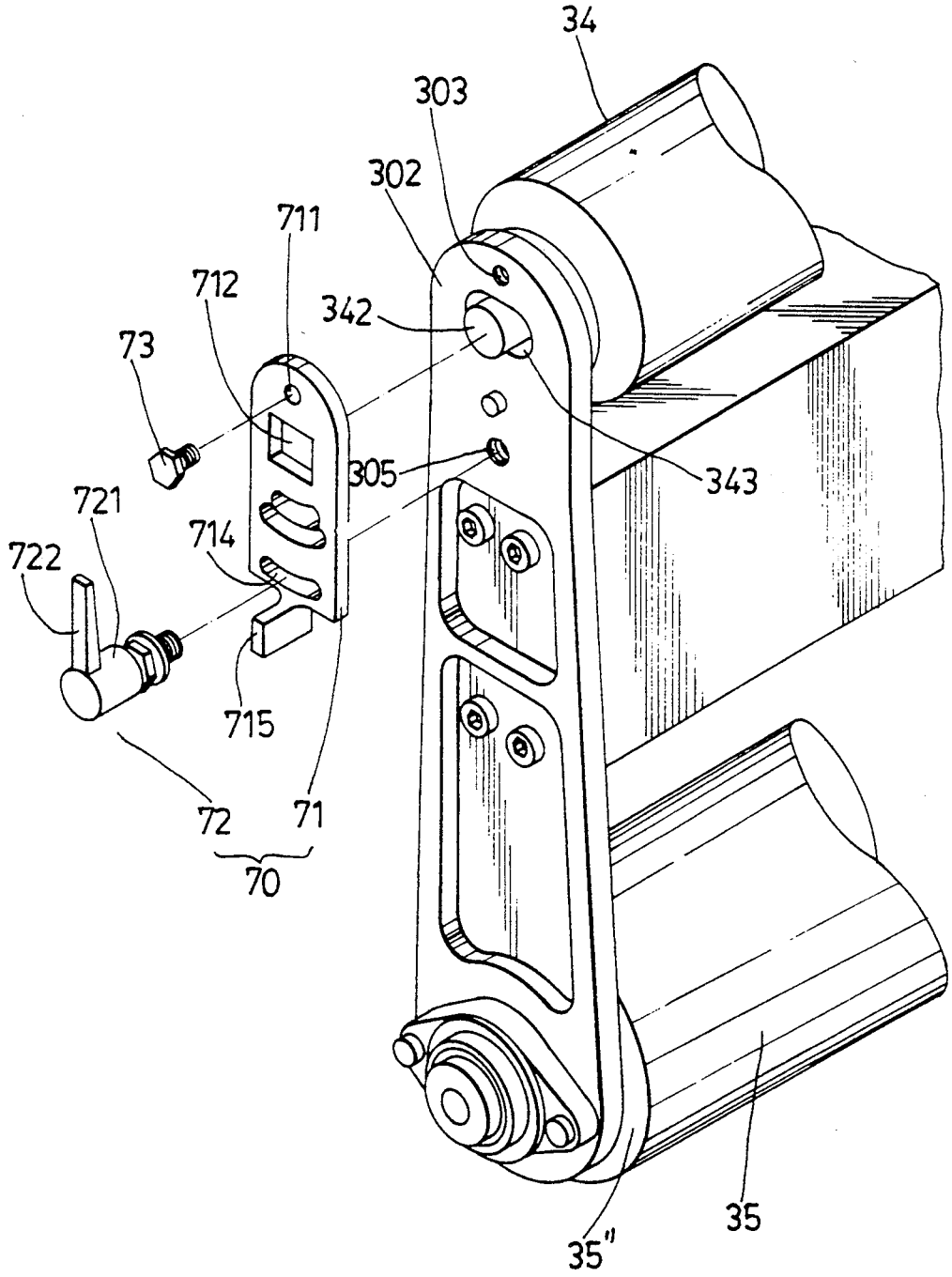
FIG. 5 is an exploded view of the adjustment unit of the preferred embodiment.
Figure 6C:
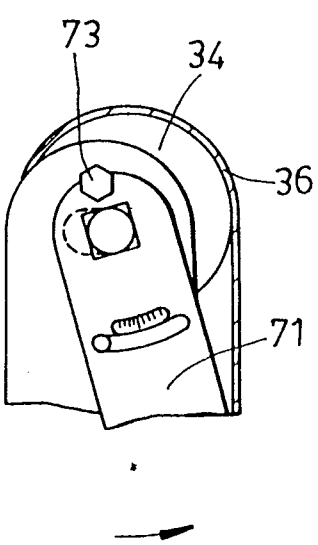
FIGS. 6(B) and 6(C) are partial schematic views of the adjustment unit showing that the plate member is movable to horizontally shift the second eccentric shaft within the elongated hole of the vertical stationary connecting plate.
Figure 6B:
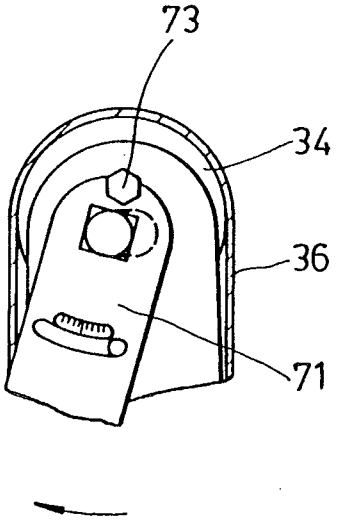
Figure 6A:
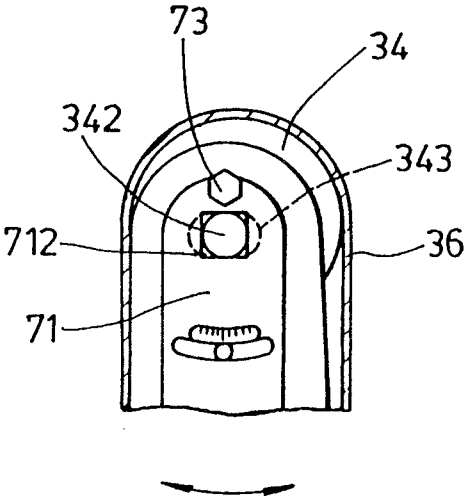
FIG. 6(A) is a partial schematic view of the adjustment unit of the preferred embodiment.

Referring to FIGS. 5 to 6(C), a vertical stationary connecting plate (302) has an upper end with a horizontally elongated hole (343) formed thereon. The second eccentric shaft (342) of the upper roller (34) movably passes through the elongated hole (343) and has a free end projecting out of the connecting plate (302). The connecting plate (302) further has a lower end connected to the second end (35") of the lower roller (35).

An adjustment unit (70) includes a plate member (71) which has an upper hole (711), a rectangular opening (712), an arc-shaped opening (714), and a lower handling projection (715). The plate member (71) is pivoted to the upper end of the connecting plate (302) by a bolt (73) passing through the upper hole (711) of the plate member (71) and engaging in a hole (303) of the connecting plate (302). The rectangular opening (712) engages the free end of the second eccentric shaft (342). The plate member (71) is moved to horizontally shift the second eccentric shaft (342) within the elongated hole (343) in the direction shown in FIG. 6(B) or in FIG. 6(C) so as to adjust the tension of the abrasive belt (36) when the upper roller is in the first position. The adjustment unit (70) further includes a locking member (72) which has a handle portion (722) and a bolt portion (721). The bolt portion (721) of the locking member (72) passes through the arc opening (714) and engages in a hole (305) of the connecting plate (302) to lock the plate member (71) to the connecting plate (302) against movement. Therefore, the abrasive belt (36) can be easily and conveniently adjusted to tensely pass over the upper and lower rollers (34, 35) in order to complete grinding operations when the abrasive belt becomes loose after a period of use.

While the present invention has been described in connection with what is considered the most practical and preferred embodiment, it is understood that this invention is not limited to the disclosed embodiment, but is intended to cover various arrangements included within the spirit and scope of the broadest interpretations and equivalent arrangements.

I claim:

1. A belt-grinding machine comprising:

a pair of upright support rods;

a mounting member mounted to said support rods in a vertically movable position, said mounting member including an upper portion, a lower portion, and a mounting shaft rotatably supported by said upper portion of said mounting member, said mounting shaft having a first and a second end respectively extending out from said mounting member;

a horizontal upper roller including an inner cylindrical member, and a coaxial outer cylindrical member being rotatable with respect to said inner cylindrical member, said inner cylindrical member having two ends, and a first and a second eccentric shaft aligned to one another and respectively extending from said two ends, said first eccentric shaft being pivotally connected to said first end of said mounting shaft;

a horizontal lower roller having a first end mounted to said lower portion of said mounting member and a second end, said lower roller being right below said upper roller in a spaced parallel position;

an abrasive belt passing over said upper and lower rollers;

a belt loosening unit including a hollow casing fixedly sleeved around said mounting shaft adjacent to said second end of said mounting shaft, a handle member attached to said second end of said mounting shaft to turn said mounting shaft to rotate said upper roller between a first position, wherein said abrasive belt tensely passes over said upper and lower rollers, and a second position, wherein the distance between the axis of said upper roller and the axis of said lower roller is smaller than in said first position and said abrasive belt loosely passes over said upper and lower rollers, a torsional spring mounted in said hollow casing and sleeved around said mounting shaft to cause said mounting shaft to return from said first position to said second position by the returning force of said torsional spring, and a locking bolt to lock said mounting shaft in said first position against rotation, said locking bolt being connected to said hollow casing and releasably engaged with said mounting member;

a vertical stationary connecting plate, said connecting plate having an upper end with a horizontally elongated hole formed thereon, said second eccentric shaft of said upper roller movably passing through said elongated hole of said upper end and having a free end projecting out of said connecting plate, said connecting plate further having a lower end connected to said second end of said lower roller; and an adjustment unit including a plate member pivoted to said upper end of said connecting plate, said plate member having an opening formed thereon which engages said free end of said second eccentric shaft, said plate member being movable to horizontally shift said second eccentric shaft within said elongated hole to adjust the tension of said abrasive belt when said upper roller is in said first position, said adjustment unit further including a locking member to lock said plate member to said connecting plate against movement.

* * * * *